US005257003A

United States Patent [19]

Mahoney

[11] Patent Number: 5,257,003

[45] Date of Patent: Oct. 26, 1993

[54] THERMISTOR AND ITS METHOD OF MANUFACTURE

[76] Inventor: John J. Mahoney, 4062 Kingswood Cir., Boise, Id. 83704

[21] Appl. No.: 821,748

[22] Filed: Jan. 14, 1992

[51] Int. Cl.[5] ..... H01C 7/10

[52] U.S. Cl. ..... 338/22 R; 338/225 D; 338/332; 29/621

[58] Field of Search ..... 338/22 R, 225 D, 322, 338/332, 323; 29/612, 619, 620, 621

[56] References Cited

U.S. PATENT DOCUMENTS 4,786,888 11/1988 Yoneda et al. ..... 338/22 R 4,912,450 3/1990 Yoneda et al. ..... 338/22 R 4,992,771 2/1991 Caporali et al. ..... 338/22 R 4,993,142 2/1991 Burke et al. ..... 338/22 R X

*Primary Examiner*—Marvin M. Lateef

*Attorney, Agent, or Firm*—Frank J. Dykas; Craig M. Korfanta; Ken J. Pedersen

[57] ABSTRACT

The invention is a thermistor comprising a thermistor element, a fixed product of a resistive film on an axial surface of the thermistor element and a conductor material on the terminal surfaces of the thermistor element. The fixed resistive film extends to the peripheral edges of the axial surface, thereby influencing conductance from the thermistor element except at its terminal ends.

18 Claims, 2 Drawing Sheets

THERMISTOR AND ITS METHOD OF MANUFACTURE

BACKGROUND OF THE INVENTION

1. Technical Field

This invention relates to temperature coefficient thermistors comprising semiconducting metal oxides, the resistance of which varies with temperature. The resistance may vary inversely with temperature, that is, it decreases with increasing temperature. This is the most common application, and these electronic components are known as negative temperature coefficient thermistors, or NTC's. However, this invention may also relate to positive temperature coefficient thermistors.

Thermistors are used, for example, as sensors in temperature monitors, compensators and controllers in solid-state electronic components.

2. Background Art

U.S. Pat. No. 4,786,888 to Yoneda, et al. discloses an NTC with a semiconducting thermistor element sintered between a pair of sheets of insulating ceramic. Internal electrodes are provided on both sides of the thermistor element, and are electrically connected, through the insulating ceramic, to corresponding external electrodes.

U.S. Pat. No. 4,912,450 to Yoneda, et al. discloses the method of making the NTC disclosed in the '888 Patent, above, which comprises:

1. Stacking a pair of green sheets of insulating ceramic material;
2. Interposing therebetween in predetermined areas a layer of thermistor element paste;
3. Providing an internal electrode paste;
4. Cutting the stacked sheets and paste into individual thermistor units;
5. Firing the thermistor units to sinter the insulating ceramic around the fired thermistor element and internal electrode paste; and
6. providing external electrodes for each thermistor unit.

Still, in the art there is a need for a simple, sturdy thermistor device with superior electrical and mechanical properties which can be manufactured easily and economically.

DISCLOSURE OF INVENTION

What I have invented is:

A thermistor comprising:

(a) a thermistor element;
(b) a fixed product of a resistive film on an axial surface of said thermistor element and extending to the peripheral edges thereof; and
(c) a conductor material on the terminal surfaces of said thermistor element.

Also, I have invented:

A method for making a thermistor which comprises:

(a) applying a resistive film on a thermistor element to cover an axial surface thereof;
(b) fixing the said thermistor element and applied resistive film to produce a fixed product of a resistive film covering an axial surface of said thermistor element;
(c) cutting the said thermistor element covered with fixed resistive film to produce terminal surfaces of thermistor element not covered with fixed resistive film; and
(d) applying conductor material to said terminal surfaces.

Alternatively, my method for making a thermistor comprises:

(a) providing a thermistor element with an axial surface and at least two (2) terminal surfaces;
(b) applying a resistive film on the axial surface to cover the axial surface up to the peripheral edges thereof;
(c) fixing the said thermistor element and applied resistive film to produce a fixed product of a resistive film covering an axial surface of said thermistor element; and
(d) applying conductor material to said terminal surfaces.

My invention provides a thermistor with improved electrical and mechanical properties, and improved manufacturability. With my invention, a thermistor with increased resistance stability, greater power dissipation and reduced zero power resistance distribution is provided. Also, the thermistor of my invention has superior appearance, free of typical ceramic anomalies. My thermistor may be easily manufactured with precision resistance tolerances in standard industry sizes, and comes with a built-in environmental barrier over the ceramic body. These advantageous features are all obtained by my invention with increased electrical and mechanical yields, and with greater quality control in electroless and electrolytic plating processes without the need to tightly control conductor material termination bands.

BEST MODE FOR CARRYING OUT INVENTION

Figure 1:
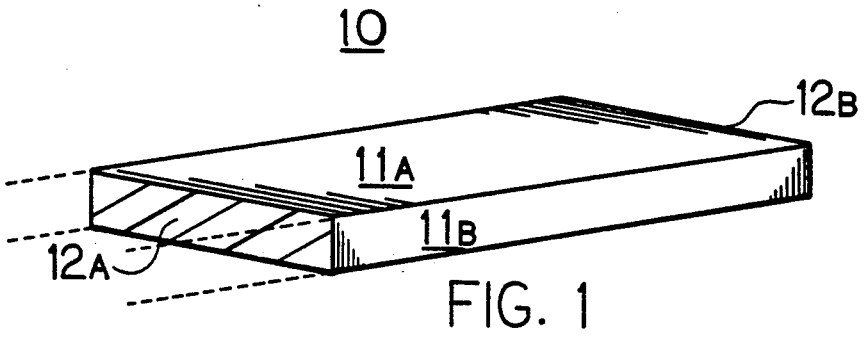
FIG. 1 is a perspective view of a thermistor element of my invention.

Referring to FIG. 1, there is depicted thermistor element 10 with side walls, or axial surfaces, 11(*a*) and 11(*b*), and terminal 12(*a*) and 12(*b*).

In this Figure, the thermistor element is a generally rectangular wafer, here depicted wider than it is thicker. However, a wafer of equal width and thickness may be used. Also, other shapes, for example, cylinders and triangular prisms may be used. In another embodiment, the thermistor element may be a strip of thermistor element applied on or in a support material like alumina, for example. In this embodiment, the thermistor may be applied as, for example, a thick film on a surface of an alumina bar or wafer, so the thermistor element itself is built onto or into the alumina.

Also, other dimensions may be used. All that my invention requires is a shape for the thermistor element which is able to provide an axial surface and two (2) terminal surfaces which are generally perpendicular to the axial surface. Dimensions of the thermistor element for surface mount applications, for example, are presently determined by industry standards and the semiconducting properties of the thermistor element as described below.

The thermistor element may be made of alumina ($Al_2O_3$), NiO, CuO, ZnO, TiO, FeO, $Fe_2O_3$, $Fe_3O_4$, $FeAl_2O_4$, $FeCr_2O_4$, $MgAl_2O_4$, $MgCr_2O_4$, $Mn_2O_3$, $ZnTiO_4$, CoO or SiC, and combinations thereof. Generally, metal oxide chips in standard surface-mount package sizes as follows:

TABLE I

| PACKAGE STYLE | LENGTH (inches) | WIDTH (inches) | THICKNESS (inches) |
|---|---|---|---|
| 0805 | 0.078 +/− 0.008 | 0.049 +/− 008 | 0.055 Max. |
| 1005 | 0.098 +/− 0.008 | 0.049 +/− 008 | 0.059 Max. |
| 1206 | 0.126 +/− 0.008 | 0.060 +/− 008 | 0.059 Max. |

are obtained by diamond slicing, or other suitable dicing method, of a ceramic wafer into strips as wide as the chip style. For example, an 0805 package style strip width would be 0.049 inches.

The thickness of the wafer is previously determined using the following equations:

$$T = \frac{RH0\ (\text{Ohm} - \text{cm})}{R25C(\text{Ohm})} \times \frac{L\ (\text{in})}{W\ (\text{in}) \times 2.54\ \frac{\text{cm}}{\text{in}}}$$

where;

T=chip thickness in inches

RHO=resistivity in ohm - centimeters

R25C=zero power resistance at 25° C. in ohms

L=length in inches

W=width in inches

In this embodiment, the wafer to be cut is cast by pouring or injecting a slurry of the metal oxide or SiC into a mold of the desired thickness, or sintered by stamping a powder of the metal oxide or SiC in a die of the desired thickness. Typically, square molds with side dimensions of 2½ inches are used in these conventional methods to provide square ceramic wafers of the desired thickness. Therefore, after cutting the formed wafer into thermistor strips for an 0805 package, the workman produces approximately 50 strips 0.049 inches wide and 2.5 inches long.

Figure 2:
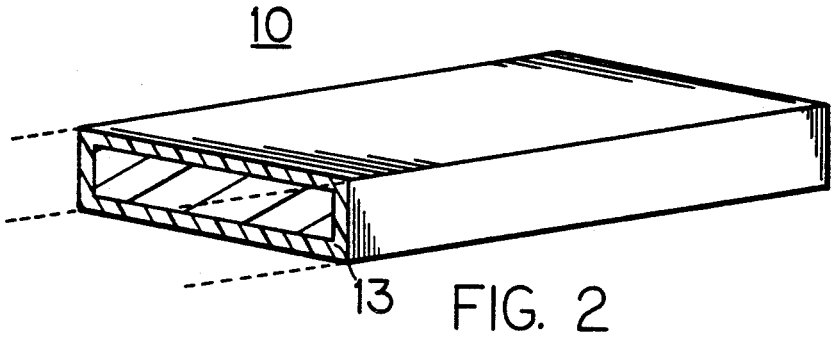
FIG. 2 is a perspective view of a thermistor element with a fixed product of a resistive film covering all of the axial surfaces thereof, according to one embodiment of my invention.

Referring to FIG. 2, there is depicted thermistor element 10 with a fixed product of a single resistive film 13 covering all the axial surfaces thereof. To produce fixed product 13, a resistive film is applied to cover completely the axial surfaces 11(*a*) and 11(*b*) of the thermistor element. The resistive film may be of an insulator, resistor, or dielectric material. The resistive film must be of a different material than the thermistor element to provide the desired electronic characteristics of my invention.

For example, the resistive film may be of a dielectric material, selected from commercially available pastes, including, for example, my preferred paste, DuPont Dielectric Composition 5704. The paste is applied by spraying or wiping it on the thermistor axial surfaces. The paste is carefully applied to obtain a desired thickness after firing according to the manufacturer's recommended firing profile. For DuPont Dielectric Composition 5704 used with palladium and silver conductor material, the fired thickness should be between 0.0015 and 0.0020 inch after firing for 30 min. from ambient to 850° C. peak temperature back to ambient with about 100° C./min. rise and descent rates.

Other dielectric thick films may be used. All that my invention requires is that, after fixing, the fixed product of the resistive film cover completely an axial surface and provide an interface between conductor material overlapping on two (2) terminal surfaces and the axial surface of the thermistor element. For dielectric materials, the strength of the interface is equal to the dielectric constant (K) of the fixed product, which preferably is a minimum of 10 meg ohm resistance under 1 volt direct current potential.

By "axial surface" I mean a surface generally parallel to a line connecting the terminal surfaces. By "terminal surface" I mean a surface created by cutting the thermistor element after the resistive film has been applied, or a surface created otherwise to provide a surface not covered with resistive film to which surface conductor material will be applied.

The resistive film may also be of insulator or resistor material. For insulators, for example, the film may be of glass, ceramic, or some other insulating material. For resistors, for example, the film may be the product of a resistive paste or ink applied to the surface of the thermistor element. Also, the resistive film may be discrete layers or patterns of dielectric, insulator or resistor materials. This way, the chip designer may create networks of electronic components on the axial surface of the thermistor element.

By "fixed product" of the resistive film, I mean the composition of the film on and in the thermistor element surface after the film has been applied to the thermistor element surface and then fixed, or secured, to the surface. Generally, the resistive film will comprise a solvent or other carrier medium, dissolved or suspended resistive particles and organic and inorganic binder materials. During firing to fix the resistive film, for example, the solvent is vaporized, and the resistive particles interact among themselves and with the binder materials to become fixed, or secured, onto and into the surface of the thermistor element. So, after firing, the "fixed product" of the resistive thick film is a layer of a network of resistive particles and binder materials fixed, or secured, onto and into the thermistor element surface.

The resistive film may be fixed by ways other than by firing. For example, the film may be fixed by chemical reaction as in an acid or oxidizing solution. Or, the resistive film may be fixed by energy action as in drying with heat or irradiating with other energy waves.

Figure 3:
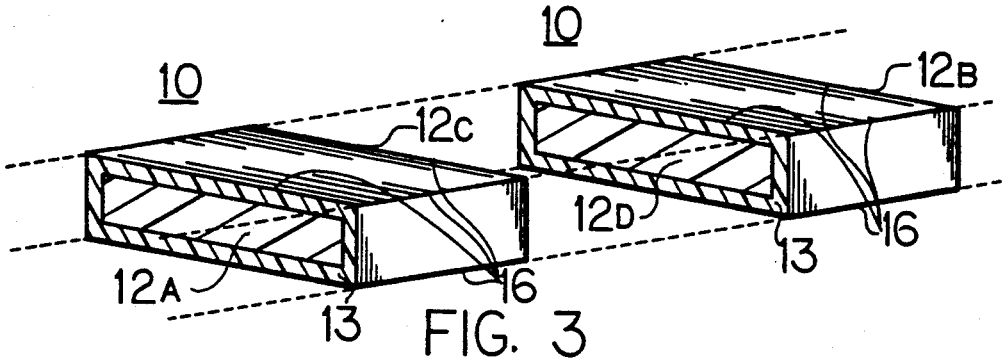
FIG. 3 is a perspective view of the thermistor-resistive film product from FIG. 2 after cutting to produce terminal surfaces of thermistor element not covered with resistive film.

Referring to FIG. 3, there is depicted the thermistor element 10 with a fixed product of a resistive film 13 from FIG. 2, but after diamond slicing, or other suitable cutting or dicing method, in a direction generally perpendicular to the axial surfaces. The slicing produces additional terminal surfaces 12(*c*) and 12(*d*) of thermistor element not covered with fixed resistive film. Multiple slices will produce multiple chips with multiple terminal surfaces 12(*c*) and 12(*d*). As a result of the slicing technique, the sliced chips are covered with a fixed product of the resistive film over an entire axial surface, or two surfaces like 11(*a*) and 11(*b*), for example, or over all the axial surfaces, including up to their peripheral edges 16. The distance between slices of the wafer strip will be determined by the package style length (L) of the chip. For example, an 0805 package style chip length would be 0.078 inches. Therefore, after cutting thermistor strip for an 0805 package, the workman produces approximately 31 chips 0.049 inches wide and 0.078 inches long, each chip having two terminal surfaces 12(*c*) and 12(*d*) of thermistor element not covered with fixed resistive film.

I prefer, from a quality standpoint, that all axial surfaces be covered with the single resistive film. Therefore, for the rectangular thermistor element depicted in the drawings, I prefer four (4) axial surfaces be covered. However, from an economy standpoint, less than all axial surfaces may be covered with the resistive film. This way, savings in materials and manufacturing steps may be realized. For example, the square wafer described above may be coated on its major top and bottom sides first, and then cut successively into strips and chips. This way, the coating step may be done quickly and easily. However, the resulting thermistor elements are covered then on only two (2) axial surfaces.

Figure 4:
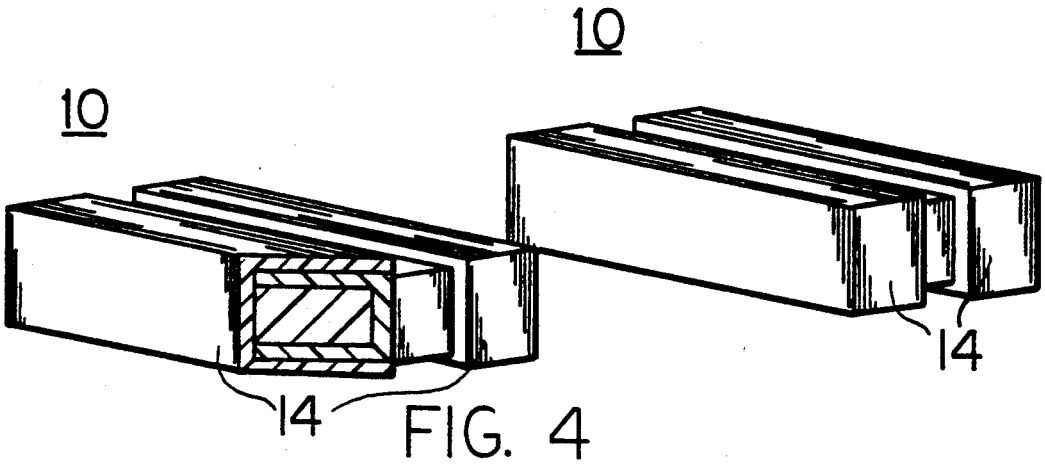
FIG. 4 is the view of FIG. 3, partly in cross-section, with conductor material applied to the terminal surfaces.

Referring to FIG. 4, there is depicted the view of FIG. 3, partly in cross-section, with conductor material 14 applied to the terminal surfaces 12(*a*), 12(*b*), 12(*c*) and 12(*d*). Conductor material 14 may be discrete layers or patterns of more or less conductive materials. This way, the chip designer may create networks of electronic components on the terminal surfaces of the thermistor element. For example, by placing a series of resistors in series with the terminal ends of the thermistor element, the designer may linearize the response of the thermistor element to temperature.

Conductor material 14 is preferably a commercially-available thick film conductor ink material matched for compatibility with the resistive film used previously to produce the fixed resistive film product. Some successfully tested thick film conductor inks and their uses are:

TABLE II

| INK | USE |
|---|---|
| DUPONT 8032 | LOW COST SOLDERABLE MATERIAL WITH LITTLE RESISTANCE SOLDER LEACHING OF SILVER. |
| DUPONT 6474 | PALLADIUM/SILVER CONDUCTOR WITH IMPROVED RESISTANCE TO SOLDER LEACHING. |
| DUPONT 6216 | SILVER CONDUCTOR SUITABLE FOR ACID PLATING BATHS. |

I prefer the DuPont 6474 formulation. The conductor material 14, if it is a thick film ink, may be applied to the thermistor terminal surfaces by dipping. Other conventional application techniques, including screen printing, spraying, and electroless and electrolytic plating, may also be used. I prefer the electroless plating method. Alternatively, the thermistor element may be provided in standard sizes before the resistive film is applied. Then, the resistive film is applied on an axial surface of the thermistor in a manner which covers the axial surface up to the peripheral edges, but which does not cover the terminal edges. For example, the standard-sized thermistor elements may be arranged in a jig which covers the terminal surfaces, and then dipped in or sprayed with the resistive film. Then the resistive film is fixed on the axial surface, the terminal surfaces are uncovered and conductor material is applied to the terminal surfaces. I prefer the coating then cutting later method described above, however, due to the difficulty of handling the tiny standard-sized elements.

Figure 5:
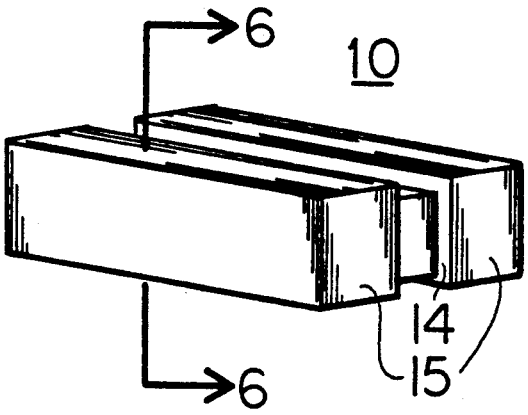
FIG. 5 is a perspective view of an alternate embodiment of my invention wherein the conductor material on the terminal surfaces coated with a protective plate to prevent migration of the conductor material during soldering.

Referring to FIG. 5, there is depicted a perspective view of an alternate embodiment of my invention wherein the conductor material 14 on the terminal surfaces is coated with, for example, a protective nickel plate to prevent migration of the conductor material into the solder material when the conductor material is soldered. The protective plate 15 may be applied in the same manner as conductor material 14, that is, by dipping, screen printing, spraying and electroless and electrolytic plating. I prefer the electroless plating method.

Figure 6:
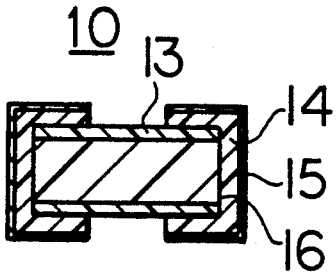
FIG. 6 is the cross-sectional view along line 6—6 in FIG. 5.

Referring to FIG. 6, there is depicted the crosssectional view along line 6—6 in FIG. 5 of the protective plated 15, applied conductor material 14 on terminal surfaces 12, and fixed resistive film product 13 on axial surfaces 11 up to the peripheral edges 16. It can be seen that, from the practice of my invention, the fixed resistive film product extends to the peripheral edges of the axial surfaces, thereby influencing conductance from the thermistor element except at its terminal ends. An advantage which results from this feature is a precisely controlled cross-sectional area for interaction between the thermistor and the conductor material at the thermistor terminal ends only, and consequently, a precisely controlled area for resistance.

While there is shown and described the present preferred embodiment of the invention, it is to be distinctly understood that this invention is not limited thereto but may be variously embodied to practice within the scope of the following claims.

I claim:

1. A method for making a thermistor which comprises:

(a) applying a single resistive film on a thermistor element to completely cover four axial surfaces thereof;

(b) fixing the said thermistor element and applied resistive film to produce a fixed product of a resistive film completely covering said four axial surfaces of said thermistor element;

(c) cutting the said thermistor element covered with fixed resistive film to produce terminal surfaces of thermistor element not covered with fixed resistive film; and (d) applying conductor material to said terminal surfaces.

2. The method of claim 1 wherein the resistive film is of a dielectric material.

3. The method of claim 1 wherein the resistive film is of an insulator material.

4. The method of claim 1 wherein the resistive film is of a resistor material.

5. The method of claim 1 wherein the resistive film comprises discrete layers of dielectric, insulator or resistor material.

6. The method of claim 1 wherein the resistive film comprises a pattern of dielectric, insulator or resistor material.

7. The method of claim 1 wherein the conductor material comprises discrete layers of more or less conductive materials.

8. The method of claim 1 wherein the conductor material comprises a pattern of more or less conductive materials.

9. The method of claim 1, which also comprises applying protective plating material on the outer surfaces of said conductor material.

10. A method for making a thermistor which comprises:

(a) providing a thermistor element with four axial surfaces and at least two (2) terminal surfaces;

(b) applying a single resistive film on all the axial surfaces to completely cover the said axial surfaces up to the peripheral edges thereof;

(c) fixing the said thermistor element and applied resistive film to produce a fixed product of a resistive film completely covering said four axial surfaces of said thermistor element; and (d) applying conductor material to said terminal surfaces.

11. The method of claim 10 wherein the resistive film is of a dielectric material.

12. The method of claim 10 wherein the resistive film is of an insulator material.

13. The method of claim 10 wherein the resistive film is of a resistor material.

14. The method of claim 10 wherein the resistive film comprises discrete layers of dielectric, insulator or resistor material.

15. The method of claim 10 wherein the resistive film comprises a pattern of dielectric, insulator or resistor material.

16. The method of claim 10 wherein the conductor material comprises discrete layers of more or less conductive materials.

17. The method of claim 10 wherein the conductor material comprises a pattern of more or less conductive materials.

18. The method of claim 10, which also comprises applying protective plating material on the outer surfaces of said conductor material.

* * * * *